United States Patent [19]

Hiro

[11] Patent Number: 4,980,254

[45] Date of Patent: Dec. 25, 1990

[54] ELECTROPHOTOGRAPHIC PHOTOSENSITIVE MEMBER HAVING CHARGE GENERATOR PIGMENT OF SPECIFIED PARTICLE SIZE DISTRIBUTION

[75] Inventor: Masaaki Hiro, Kanagawa, Japan

[73] Assignee: Canon Kabushiki Kaisha, Tokyo, Japan

[21] Appl. No.: 488,383

[22] Filed: Feb. 23, 1990

Related U.S. Application Data

[63] Continuation of Ser. No. 220,438, Jul. 13, 1988, abandoned, which is a continuation of Ser. No. 865,921, May 14, 1986, abandoned, which is a continuation of Ser. No. 703,452, Feb. 20, 1985, abandoned, which is a continuation of Ser. No. 493,950, May 12, 1983, abandoned.

[30] Foreign Application Priority Data

May 19, 1982 [JP] Japan ..... 57-83252

[51] Int. Cl.[5] ..... G03G 5/14

[52] U.S. Cl. ..... 430/58; 430/59; 430/135

[58] Field of Search ..... 430/58, 135, 59

[56] References Cited

U.S. PATENT DOCUMENTS

| | | | |
|---|---|---|---|
| 3,899,333 | 8/1975 | Berman et al. | 430/413 |
| 4,135,925 | 1/1979 | Wells | 430/33 |
| 4,233,383 | 11/1980 | Horgan | 430/58 |
| 4,282,298 | 8/1981 | Smith et al. | 430/58 |
| 4,301,224 | 11/1981 | Kozima et al. | 430/135 |
| 4,352,876 | 10/1982 | Suzuki et al. | 430/59 |
| 4,399,206 | 8/1983 | Katagiri et al. | 430/58 |
| 4,446,217 | 5/1984 | Takasu et al. | 430/60 |

FOREIGN PATENT DOCUMENTS 57-54942 4/1982 Japan .

*Primary Examiner*—David Welsh

*Attorney, Agent, or Firm*—Fitzpatrick, Cella, Harper & Scinto

[57] ABSTRACT

An electrophotographic photosensitive member having an electroconductive substrate and a photosensitive layer or layers contains pigment particles of 0.5 $\mu$ or below in size in an amount of 80% or more in weight or number of the total pigment. The particles of the above-mentioned size distribution are dispersed in a binder.

21 Claims, No Drawings

ELECTROPHOTOGRAPHIC PHOTOSENSITIVE MEMBER HAVING CHARGE GENERATOR PIGMENT OF SPECIFIED PARTICLE SIZE DISTRIBUTION

This application is a continuation of application Ser. No. 220,438 filed July 13, 1988, now abandoned, which in turn is a continuation of application Ser. No. 865,921, filed May 14, 1986, now abandoned, which in turn, is a continuation of application Ser. No. 703,452, filed Feb. 20, 1985, now abandoned, which, in turn, is a continuation of application Ser. No. 493,950, filed May 12, 1983, now abandoned.

BACKGROUND OF THE INVENTION

1. Field of the Invention

The present invention relates to an electrophotographic photosensitive member, and more particularly, to an electrophotographic photosensitive member having functionally specialized photosensitive layers comprising a charge generation layer forming an electric charge on exposure to light and a charge transport layer transporting the generated charge.

2. Description of the Prior Art

Inorganic photoconductive materials such as selenium, cadmium sulfide, zinc oxide and the like have been widely known heretofore.

On the other hand, various organic photoconductive polymers have been proposed such as polyvinyl carbazole and the like. Such polymers have indeed satisfactory transparency, film-forming property and flexibility. Nevertheless, those polymers have not been commercialized until now because they are inferior to inorganic photoconductive materials in photosensitivity, durability, and stability to the variation of the environment. A photosensitive member prepared from an organic photoconductive material of low molecular weight combined with a binder has also been proposed, but it does not have sufficient photosensitivity yet.

In order to remove such drawbacks, a laminated structure has been proposed lately wherein the photosensitive layer is functionally divided into two layers of a charge generating layer and a charge transport layer, for example, in the disclosure in the U.S. Pat. No. 3,837,851 and No. 3,871,882. The sensitivity of the photosensitive layer having such laminated structure is known to be affected by the thickness ratio of the charge generation layer to the charge transport layer, as is disclosed in Australian Laid-open Patent Specification No. 87757/75.

The inventors, after a lot of study, have found that the size distribution of the pigment used in the charge generation layer has a great influence on the photosensitivity, and have accomplished the present invention.

SUMMARY OF THE INVENTION

According to one aspect of the present invention, there is provided an electrophotographic photosensitive member having an electroconductive substrate and a photosensitive layer or layers, characterized in that the photosensitive layer or layers contains pigment particles of 0.5μ or below in size in an amount of 80% or more in weight or number of the total pigment particles, and the particles of said size distribution are dispersed in a binder.

According to another aspect of the present invention, there is provided an electrophotographic process which comprises:

(a) a step of charging an electrophotographic photosensitive member having a charge generation layer and a charge transport layer on an electroconductive substrate, said charge generation layer containing pigment particles of 0.5μ or below in size in an amount of 80% or more in weight or number, and the particles in said size distribution being dispersed in an organic binder resin.

(b) a step of exposing the charged electrophotographic photosensitive member.

(c) a step of developing with a developer.

According to a further aspect of the present invention, there is provided an electrophotographic process which comprises carrying out the following steps (a), (b), (c), (d) and (e) at least twice:

(a) a step of charging an electrophotographic photosensitive member having a charge generation layer and a charge transport layer on an electroconductive substrate, said charge generation layer containing pigment particles of 0.5μ or below in size in an amount of 80% or more in weight or number, and the particles in said size distribution being dispersed in an organic binder resin, (b) a step of exposing the charged electrophotographic photosensitive member, (c) a step of developing using a developer, (d) a step of transferring the developed images onto a receiving member, (e) a step of cleaning the remaining developer.

According to a further aspect of the present invention, there is provided an electrophotographic process which comprises:

(a) a step of charging an electrophotographic photosensitive member having a charge generation layer and a charge transport layer on an electroconductive substrate, said charge generation layer containing pigment particles of 0.5μ or below in size in an amount of 80% or more in weight or number, and the particles in said size distribution being dispersed in an organic binder resin, (b) a step of exposing the charged electrophotographic photosensitive member by laser beam scanning, (c) a step of developing with a developer.

According to a further aspect of the present invention, there is provided an electrophotographic process which comprises carrying out the following steps (a), (b), (c), (d) and (e) at least twice:

(a) a step of charging an electrophotographic photosensitive member having a charge generation layer and a charge transport layer on an electroconductive substrate, said charge generation layer containing pigment particles of 0.5μ or below in size in an amount of 80% or more in weight or number, and the particles in said size distribution being dispersed in an organic binder resin, (b) a step of exposing the charged electrophotographic photosensitive member with laser beam scanning, (c) a step of developing with a developer, (d) a step of transferring developed images onto a receiving member, (e) a step of cleaning the remaining developer.

According to a further aspect of the present invention, there is provided an electrophotographic process which comprises:

(a) a step of charging an electrophotographic photosensitive member having a photosensitive layer or layers on an electroconductive substrate, said photosensitive layer comprising pigment particles of 0.5μ or below in size in an amount of 80% or more in weight or number, and the particles in said size distribution being dispersed in an organic binder resin, (b) a step of exposing the charged electrophotographic photosensitive member, (c) a step of developing with a developer.

According to a further aspect of the present invention, there is provided an electrophotographic process which comprises carrying out the following steps (a), (b), (c), (d) and (e) at least twice:

(a) a step of charging an electrophotographic photosensitive member having a photosensitive layer or layers on an electroconductive substrate, said photosensitive layer containing pigment particles of 0.5μ or below in size in an amount of 80% or more in weight or number, and the particles in said size distribution being dispersed in an organic binder resin, (b) a step of exposing the charged electrophotographic photosensitive member, (c) a step of developing with a developer, (d) a step of transferring the developed images onto a receiving member, (e) a step of cleaning the remaining developer.

DESCRIPTION OF THE PREFERRED EMBODIMENT

In an electrophotographic photosensitive member of a laminated structure comprising a conductive substrate, a charge generation layer and a charge transport layer laminated in this order, the preferred embodiment of the present invention uses the charge generating pigment of such a particle size distribution that the particles of 0.5μ or below, preferably 0.3μ or below, especially preferably 0.1μ or below or the most preferably 0.01μ or below in size account for 80% or more in weight or number of the total pigment, and the pigment particles are dispersed in a binder, serving as a charge generation layer.

The charge generating layer of the present invention is formed by coating the binder dispersion of the charge generating pigment particles of the above-mentioned particle size distribution onto the electroconductive substrate by various coating methods such as dip coating, spray coating, spinner coating, bead coating, Meyer bar coating, blade coating, roller coating, curtain coating, and the like, and then drying it. The thickness of the charge generation layer is preferably 0.01μ–1 μ, and the smaller thickness causes the lower sensitivity. The larger thickness lowers a charging potential, leading to an increased optical memory.

The weight ratio of the charge generating pigment to the binder is usually in the range of from about 5:1 to 1:5, preferably from about 2:1 to 1:4.

The preparation of the dispersion in the present invention is carried out generally by mixing and dispersing the pigment with an organic binder resin using a sand mill or a ball mill, but the pigment in a dry state, such as in crystal or powder state may be separately and preliminarily pulverized to obtain the required particle size distribution using a commercially available pulverizer such as a ball mill, a jet mill and the like, and then may be dispersed in a binder.

Otherwise, the pigment in a slurry or suspension state may be pulverized by means of a sand mill or a ball mill to obtain the required particle size distribution and then may be dispersed in the binder. The method for preparing the binder dispersion is not limited to the above-described one, but any method may be used as long as a binder dispersion of the pigment particles of the above-mentioned particle size distribution can be obtained.

Various filters, such as "Membrane Filter" supplied by Toyo Kagaku Sangyo K.K. may be used for preparing the pigment particles of the above-mentioned particle size distribution.

The particle size distribution may be measured by means of Horiba centrifugal automatic particle size distribution measuring apparatus made by Horiba, Ltd. This apparatus measures the changes of absorption per unit time to give particle size distributions. The dependence of time of sedimentation on particle diameters is represented by Stokes' equation (1) shown below, which is derived from the phenomenon that particles of larger size settle faster than smaller ones. For centrifugal sedimentation $$D = \left( \frac{18\ \eta_o \ln (X_2/X_1)}{(\rho - \rho_o)\ \omega^2 t} \right)^{\frac{1}{2}} \quad (1)$$

where

D:particle size (cm)

$\eta_o$:viscosity coefficient of solvent

H:distance of settling (cm)

$\rho$:density of sample (g/cm$^3$)

$\rho_o$:density of solvent (g/cm$^3$)

$\rho_o$:density of solvent (g/cm$^3$)

t:time of sedimentation (sec)

$X_1$:distance from the center of rotation to the plane of sedimentation (cm)

$X_2$:distance from the center of rotation to the plane of measurement (cm)

$\omega$:angular velocity (rad/sec)

g:gravitational acceleration (cm/s$^2$)

On the other hand, formula (2) is known to hold between settling particles and light absorption $$\ln Io - \ln Ii = K \sum_{i=1}^{n} NiDi^2 \quad (2)$$

where

Io:quantity of transmitted light through solvent

Ii:quantity of transmitted light in the presence of particles Di

K:constant

Ni:numbers of particles Di

Di:diameter of the i-th particle ($NiDi^2$) in formula (2) is based on area, and by multiplying formula (2) by Di the base is converted to volume. Therefore, the measurement of the change of the concentration (absorption) of a pigment dispersion can give a particle size distribution.

As the examples of the charge generating substances, there may be mentioned photoconductive substances as shown below: azo pigments (disazo pigments and trisazo pigments) such as Sudan Red, Diane Blue, and Janus Green B; quinone pigments such as Algol Yellow, Pyrene Quinone, and Indanthrene Brilliant Violet RRP; chinocyanine pigments; pyrene pigments; indigo pigments such as indigo, thioindigo and the like; bisbenzimidazole pigments such as Indofast Orange toner and the like; phthalocyanine pigments such as copper phthalocyanine and the like; quinacridone pigments, and the like.

Among various binders, organic binder resins are especially suitable for the present invention, and there may be used preferably polyester, polystyrene, polyvinyl chloride, polyvinyl acetate, acrylic resins, polyvinylpyrrolidone, methylcellulose, hydroxypropyl methycellulose, polyvinylbutyral, cellulose acetate butyrate and the like.

As a solvent for preparing the dispersion, there may be used methyl ethyl ketone, cyclohexanone, ethyl acetate, water and the like which easily dissolve the organic binder resin.

As an electroconductive substrate in the present invention which is coated with the charge generating layer, there may be used electroconductive materials such as aluminum, aluminum alloy, copper and the like, plastics having vacuum-deposited metal layer, a substrate consisting of plastics coated by electroconductive particles along with a suitable binder, a substrate obtained from plastics or paper having electroconductive particles immersed or dispersed into it, and plastics containing electroconductive polymer.

Undercoat having barrier and adhesion function may be provided between the electroconductive substrate and the charge generating layer. The undercoat may be formed of casein, polyvinyl alcohol, polyamide or the like, and the thickness of the film is usually 0.1μ–5μ, preferably 0.5μ–3μ.

The charge transport layer overlying the charge generating layer is formed by blending a film-forming resin with a charge transporting compound that has a radical or radicals of polynuclear aromatic compounds such as anthracenes, pyrenes, phenanthrenes, coronenes, and the like in the main chain or the side chain, or nitrogen-containing heterocyclic compounds such as indoles, carbazoles, oxazoles, isoxazoles, thiazoles, imidazoles, pyrazoles, oxadiazoles, pyrazolines, thiaziazoles, triazoles, and the like in the main chain or the side chain, or hydrazones. This is because such charge transporting substances are generally low molecular weight compounds and have poor film-forming ability. As such resins, there may be used polyesters, polysulfones, polycarbonates, polymethacrylates, polystyrenes, and the like.

The charge transport layer is preferably 5μ–20μ in thickness, and may contain various additives such as diphenyl, o-terphenyl, p-terphenyl, dibutyl phthalate, dimethylglycol phthalate, dioctyl phthalate, triphenyl phosphoric acid, methylnaphthalene, benzophenone, chlorinated paraffines, dilauryl thiopropionate, 3,5-dinitrosalicylic acid, and various fluorocarbons.

The electrophotographic photosensitive member of the present invention may be used not only for electrophotographic copiers but also used in the application fields of electrophotography such as laser printer using argon gas laser, helium-neon gas laser, or semiconductor laser, CRT printer and electrophotographic plate making systems.

The following examples will illustrate the present invention.

EXAMPLE 1

As a charge generating material, there was used a disazo pigment of the structural formula:

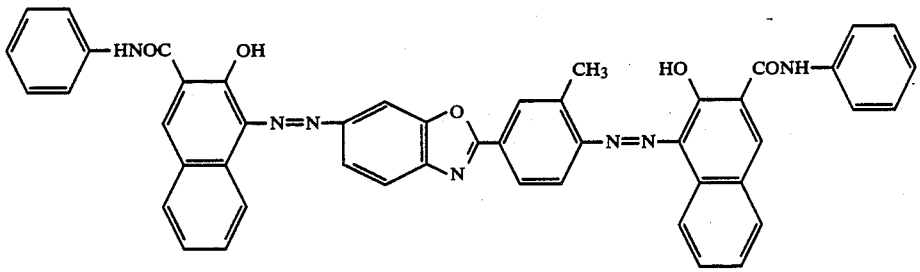

and as an organic binder resin there was used polyvinyl butyral resin (Trade Name Eslec BM-2, made by Sekisui Chemical Co., Ltd.).

3 g of the above-mentioned diazo pigment was added to the resin solution made by dissolving 1.5 g of polyvinylbutyral resin in 50 g of cyclohexanone and was dispersed by means of a sand mill to prepare the dispersion of charge generating pigment particles in an organic binder resin. The particle distribution of the dispersion was measured by the particle size distribution measuring apparatus (CAPA-500, made by Horiba, Ltd.). At the same time, there were used reference samples in which the pigment is removed from the test samples. In the examples hereinafter, the particle distributions were measured in the same manner as in this example.

Table 1 shows the conditions of dispersing and the resulting particle size distributions.

TABLE 1

| Sample No. | Time of dispersion (Hours) | Particle size distribution (weight %) less than 0.02μ | 0.02~0.06μ | 0.06~0.1μ | 0.1~0.3μ | 0.3~0.5μ | 0.5~1μ | more than 1μ |
|---|---|---|---|---|---|---|---|---|
| 1-1 | 0.25 | — | — | 6.2 | 23.7 | 30.2 | 34.7 | 5.2 |
| 1-2 | 1 | 2.4 | 9.2 | 28.4 | 31.8 | 22.4 | 4.6 | 1.2 |
| 1-3 | 5 | 14.0 | 37.7 | 25.5 | 14.6 | 7.6 | 0.6 | — |
| 1-4 | 10 | 39.0 | 31.9 | 17.1 | 8.1 | 3.7 | 0.2 | — |
| 1-5 | 20 | 59.2 | 22.7 | 10.3 | 5.2 | 2.6 | — | — |
| 1-6 | 40 | 68.4 | 19.5 | 8.4 | 2.9 | 0.8 | — | — |

The figures in the Table are the ones that are obtained by converting the measured volume-based percentage into weight percentage.

The above-mentioned dispersion was applied onto the aluminum cylinder of 80 mmϕ×300 mm undercoated with casein of 3μ thick, by dip coating, and dried at 100° C. for 10 minutes to form a charge generating layer of 0.8μ thick.

Then 10 parts of 1-[pyridyl-(2)]-3-(4-N,N-diethylaminostyryl)-5-(4-N,N-diethylaminophenyl pyrazoline, and 10 parts of polysulfone resin (Trade Name: U-Del P-1700, made by UCC) was dissolved in 80 parts of monochlorobenzene, and the solution was applied onto the charge generation layer by dip coating, and was dried with hot air at 100° C. to form a charge transport layer of 12μ thick.

The electrophotographic photosensitive member thus prepared was set on an electrophotographic copier having steps of corona charging of −5.6 KV, image forming, light exposure, dry development using dry toner developer, toner transfer to plain paper (a receiving member), and cleaning by urethane rubber blade. The sensitivity (expressed by the quantity of exposure light necessary to reduce the surface potential of a photosensitive member to half value) was determined. Table 2 shows the results.

The sensitivity was largely dependent on the particle size distribution of the charge generating substances, and the samples of Nos. 2–6 of the present invention had high sensitivities.

TABLE 2

| Photo-sensitive member No. | Charge generating pigment dispersion No. | Surface potential (volts) | Sensitivity (lux · sec.) |
|---|---|---|---|
| 1 | 1-1 | −550 | 13.0 |
| 2 | 1-2 | −560 | 10.5 |
| 3 | 1-3 | −565 | 6.4 |
| 4 | 1-4 | −560 | 5.4 |
| 5 | 1-5 | −540 | 5.5 |
| 6 | 1-6 | −550 | 4.8 |

EXAMPLE 2

As a charge generating material, a disazo pigment of the following structural formula was used:

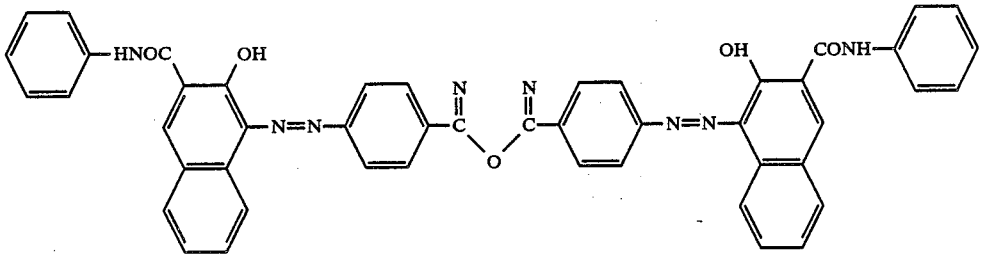

and an alcohol-soluble phenolic resin (Trade Name: Plyophen 5010, supplied by Dai Nippon Ink and Chemicals Inc.) was used as the organic binder resin.

2.6 g of the above-mentioned alcohol-soluble phenolic resin (solid content: 58%) and 50 g of ethanol were mixed well, and the above-mentioned disazo pigment was added to the resulting mixture and dispersed by a sand mill to prepare an organic binder resin dispersion of charge generating pigment particles.

The above-mentioned dispersion was applied onto an aluminum cylinder of 80 mmϕ×300 mm undercoated with casein of 3μ thick by dip coating, and dried at 80° C. for 5 minutes to form a charge generation layer of 0.9μ thick.

Then, the same charge transport layer as in Example 1 was formed on the charge generation layer and the sensitivity of the electrophotographic photosensitive member thus obtained was measured in the same manner as in Example 1.

The results are shown in Table 3.

TABLE 3

| Sample No. | Charge generating pigment dispersion Sample No. | Time of dispersion (Hours) | Particle size distribution (Weight %) less than 0.02μ | 0.02~0.06μ | 0.06~0.1μ | 0.1~0.3μ | 0.3~0.5μ | 0.5~1μ | more than 1μ | Surface potential (V) | Sensitivity (lux · sec) |
|---|---|---|---|---|---|---|---|---|---|---|---|
| 7 | 2-1 | 0.25 | — | — | — | 25.1 | 40.6 | 19.5 | 14.8 | −545 | 16.5 |
| 8 | 2-2 | 10 | 28.6 | 45.0 | 18.6 | 4.6 | 2.6 | 0.6 | — | −560 | 7.6 |
| 9 | 2-3 | 20 | 50.8 | 33.7 | 10.1 | 4.1 | 1.2 | 0.1 | — | −550 | 5.9 |
| 10 | 2-4 | 40 | 71.3 | 18.7 | 5.9 | 3.2 | 0.9 | — | — | −560 | 5.4 |

EXAMPLE 3

A trisazo pigment of the structural formula as shown below was used as a charge generating material:

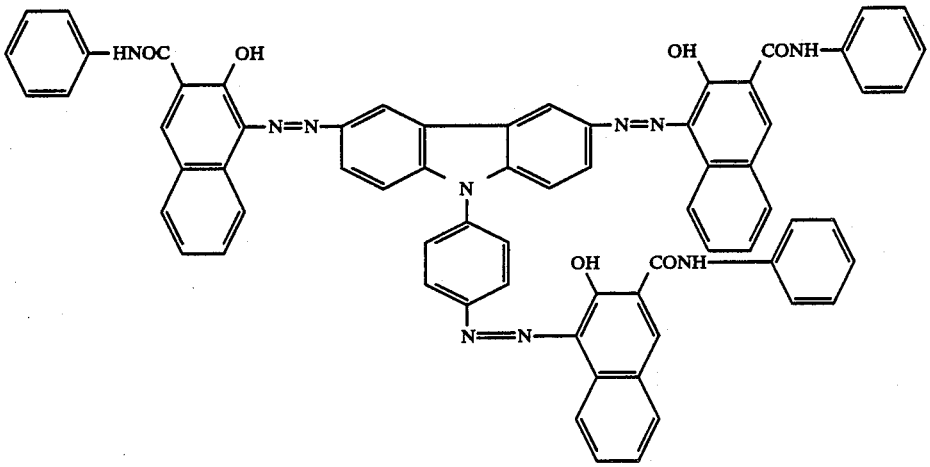

Polyvinylbutyral (trade name: Eslec BM-1, supplied by Sekisui Chemical Co., Ltd.) was used as a binder, and was dispersed by a sand mill using isopropyl alcohol as a solvent to obtain a dispersion of a charge generating pigment particles in an organic binder resin in the same manner as in Example 1.

The above-mentioned dispersion was applied onto an aluminum cylinder of 80 mmϕ×300 mm undercoated with casein of 3μ thick by dip coating, and dried at 80° C. for 5 minutes to obtain a charge generation layer of 0.8μ thick.

Then the same charge transport layer as in Example 1 was formed on the charge generation layer to prepare an electrophotographic photosensitive member. The photosensitive member thus obtained was set on the electrophotographic copier used in Example 1, and the light portion potential ($V_L$) and the dark portion potential ($V_D$) were measured. The sensitivity was measured in the same manner as in Example 1, wherein the quantity of exposure light was controlled so that the initial $V_L$ of the photosensitive member of Sample No. 11 be −50V at the exposure.

The results are shown in Table 4.

TABLE 4

| Photosensitive member No. | Charge generating pigment dispersion No. | Time of dispersion (Hours) | Particle size distribution (Weight %) less than 0.02μ | 0.02~0.06μ | 0.06~0.1μ | 0.1~0.3μ | 0.3~0.5μ | 0.5~1μ | more than 1μ | $V_L$ (volts) | $V_D$ (volts) | Sensitivity (lux · sec) |
|---|---|---|---|---|---|---|---|---|---|---|---|---|
| 11 | 3-1 | 0.25 | — | — | — | 10.8 | 59.6 | 16.8 | 12.8 | −50 | −550 | 14.8 |
| 12 | 3-2 | 20 | 17.8 | 20.1 | 30.8 | 24.7 | 5.8 | 0.8 | — | −60 | −560 | 6.3 |
| 13 | 3-3 | 40 | 15.4 | 38.5 | 26.9 | 15.5 | 3.3 | 0.4 | — | −50 | −560 | 5.2 |

The photosensitive members of Sample Nos. 11–13 were set respectively on the electrophotographic copier used in Example 1 and were repeatedly subjected to the electrophotographic process comprising charging, exposure, development, image transfer, cleaning, and discharge by exposure. When 10,000 copies were made, the light portion potential ($V_L$) and the dark portion potential ($V_D$) of each photosensitive member were measured in the same manner as in Example 1. The results are shown in Table 5.

TABLE 5

| Photosensitive Member Sample No. | After 10,000 copies were made $V_L$ (volts) | $V_D$ (volts) | Sensitivity (lux − sec) |
|---|---|---|---|
| 11 | −70 | −410 | 25.7 |
| 12 | −80 | −500 | 8.6 |
| 13 | −70 | −520 | 7.3 |

What is claimed is:

1. An electrophotographic photosensitive member having an electroconductive substrate and at least one photosensitive layer of a laminate comprising a charge generation layer and a charge transport layer wherein the charge generation layer contains at least 77.2% by weight of pigment particles which are no greater than 0.1μ in size and at least 14% by weight of pigment particles which are no greater than 0.02μ in size, said weights based on the total pigment particles and wherein the particles are azo pigments, said azo pigments dispersed in an organic binding resin.

2. An electrophotographic photosensitive member according to claim 1, wherein the pigment particles are disazo pigment particles or trisazo pigment particles.

3. An electrophotographic photosensitive member according to claim 1, wherein the charge generation layer comprises pigment particles and an organic binder resin in the weight ratio of from 5:1 to 1:5.

4. An electrophotographic photosensitive member according to claim 3, wherein the charge generation layer comprises pigment particles and an organic binder resin in the weight ratio of from 2:1 to 1:4.

5. An electrophotographic photosensitive member according to claim 1, wherein the charge generation layer has a film thickness of from 0.01μ to 1μ.

6. An electrophotographic photosensitive member according to claim 1, which has a photosensitive layer or layers of a laminated structure wherein a charge transport layer is laminated contiguously onto a charge generation layer.

7. An electrophotographic photosensitive member according to claim 6, wherein the charge transport layer comprises at least one compound selected from the group consisting of polynuclear aromatic compounds, nitrogen-containing heterocyclic compounds and hydrazone compounds, and an organic binder resin.

8. An electrophotographic photosensitive member according to claim 7, wherein the charge transport layer comprises at least one hydrazone compound and an organic binder resin.

9. An electrophotographic photosensitive member according to claim 7, wherein the charge transport layer comprises at least one pyazoline compound and an organic binder resin.

10. An electrophotographic photosensitive member according to claim 6, wherein an undercoat layer is present between the electroconductive substrate and the charge generation layer.

11. An electrophotographic photosensitive member according to claim 10, wherein the undercoat layer is a film of casein, polyvinyl alcohol, or polyamide.

12. An electrophotographic photosensitive member according to claim 11, wherein the undercoat layer is a film of polyamide.

13. An electrophotographic process which comprises:

(a) charging an electrophotographic photosensitive member having a charge generation layer and a charge transport layer on an electroconductive substrate, said charge generation layer containing at least 77.2% by weight of pigment particles which are no greater than 0.1μ in size and at least 14% by weight of pigment particles which are no greater than 0.02μ in size, said weights based on the total pigment particles and wherein the particles are azo pigments, said azo pigments being dispersed in an organic binder resin;

(b) exposing the charged electrophotographic photosensitive member; and (c) developing said exposed member.

14. An electrophotographic process which comprises:

(a) charging an electrophotographic photosensitive member having a charge generation layer and a charge transport layer on an electroconductive substrate, said charge generation layer containing at least 77.2% by weight of pigment particles which are no greater than 0.1μ in size and at least 14% by weight of pigment particles which are no greater than 0.02μ in size, said weights based on the total pigment particles and wherein the particles are azo pigments, said azo pigments being dispersed in an organic binder resin;

(b) exposing the charged electrophotographic photosensitive member to form latent images;

(c) developing said latent images;

(d) transferring the developed images onto a receiving member;

(e) cleaning developer remaining on said photosensitive member; and repeating steps (a)–(e) at least once.

15. An electrophotographic process which comprises:

(a) charging an electrophotographic photosensitive member having a charge generation layer and a charge transport layer on an electroconductive substrate, said charge generation layer containing at least 77.2% by weight of pigment particles which are no greater than 0.1μ in size and at least 14% by weight of pigment particles which are no greater than 0.02μ in size, said weights based on the total pigment particles and wherein the particles are azo pigments, said azo pigments being dispersed in an organic binder resin;

(b) exposing the charged electrophotographic photosensitive member by laser beam scanning; and (c) developing said exposed member.

16. An electrophotographic process which comprises:

(a) charging an electrophotographic photosensitive member having a charge generation layer and a charge transport layer on an electroconductive substrate, said charge generation layer containing at least 77.2% by weight of pigment particles which are no greater than 0.1μ in size and at least 14% by weight of pigment particles which are no greater than 0.02μ in size, said weights based on the total pigment particles and wherein the particles are azo pigments, said azo pigments being dispersed in an organic binder resin;

(b) exposing the charged electrophotographic photosensitive member with laser beam scanning to form images;

(c) developing said images;

(d) transferring developer remaining on said photosensitive member;

(e) cleaning developer remaining on said photosensitive member; and repeating steps (a)–(e) at least once.

17. An electrophotographic process which comprises:

(a) charging an electrophotographic photosensitive member having at least one photosensitive layer on an electroconductive substrate, said photosensitive layer comprising at least 77.2% by weight of pigment particles which are no greater than 0.1μ in size and at least 14% by weight of pigment particles which are no greater than 0.02μ in size, said weights based on the total pigment particles and wherein the particles are azo pigments, said azo pigments being dispersed in an organic binder resin;

(b) exposing the charged electrophotographic photosensitive member; and (c) developing said exposed member.

18. An electrophotographic process which comprises:

(a) charging an electrophotographic photosensitive member having at least one photosensitive layer on an electroconductive substrate, said photosensitive layer containing at least 77.2% by weight of pigment particles which are no greater than 0.1μ in size and at least 14% by weight of pigment particles which are no greater than 0.02μ in size, said weights based on the total pigment particles and wherein the particles are azo pigments, said azo pigments being dispersed in an organic binder resin;

(b) exposing the charged electrophotographic photosensitive member to form a latent image thereon:

(c) developing the latent image;

(d) transferring the developed image onto a receiving member;

(e) cleaning developer remaining on said photosensitive member; and repeating steps (a)–(e) at least once.

19. An electrophotographic process which conprises:

(a) charging an electrophotographic photosensitive member having at least one photosensitive layer on an electroconductive substrate, said photosensitive layer containing at least 77.2% by weight of pigment particles which are no greater than 0.1μ in size and at least 14% by weight of pigment particles which are no greater than 0.02μ in size, said weights based on the total pigment particles and wherein the particles are azo pigments, said azo pigments being dispersed in an organic binder resin;

(b) exposing the charged electrophotographic photosensitive member to form a latent image thereon;

(c) developing said image;

(d) transferring the developed image onto a receiving member;

(e) cleaning developer remaining on said photosensitive member;

(f) discharging said photosensitive member by exposure; and repeating steps (a)–(e) at least once.

20. An electrophotographic photosensitive member having an electroconductive substrate and at least one photosensitive layer characterized in that said photosensitive layer contains at least 77.2% by weight of pigment particles which are no greater than 0.1μ in size and at least 14% by weight of pigment particles which are no greater than 0.02μ in size, said weights based on the total pigment particles and wherein the particles are azo pigments, said azo pigments dispersed in an organic binding resin.

21. An electrophotographic photosensitive member according to claim 20, wherein the pigment particles are disazo pigment particles or trisazo pigment particles.

* * * * *

UNITED STATES PATENT AND TRADEMARK OFFICE

CERTIFICATE OF CORRECTION

PATENT NO. : 4,980,254

DATED : December 25, 1990

INVENTOR(S) : MASAAKI HIRO

It is certified that error appears in the above-identified patent and that said Letters Patent is hereby corrected as shown below:

COLUMN 4

Line 32, "$\rho_o$:density of solvent (g/cm$^3$)" should be deleted.

COLUMN 6

Line 39, "diazo" should read --disazo--.

COLUMN 7

Line 5, "diethylaminophenyl pyrazo-" should read --diethylaminophenyl) pyrazo- --.

COLUMN 8

Line 20, " 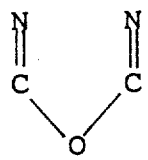 " should read -- 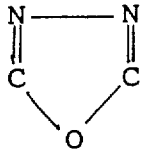 --.

COLUMN 9

Line 41, "be" should read --was--.

COLUMN 10

Line 42, "organic binding resin." should read --organic binder resin.--.

UNITED STATES PATENT AND TRADEMARK OFFICE

CERTIFICATE OF CORRECTION

PATENT NO. : 4,980,254

DATED : December 25, 1990

INVENTOR(S) : MASAAKI HIRO

It is certified that error appears in the above-identified patent and that said Letters Patent is hereby corrected as shown below:

COLUMN 11

Line 18, "pyazoline compound" should read --pyrazoline compound--.

COLUMN 14

Line 16, "binding resin." should read --binder resin.--.

Signed and Sealed this

Twenty-first Day of July, 1992

*Attest:*

DOUGLAS B. COMER

*Attesting Officer*

*Acting Commissioner of Patents and Trademarks*